US009238515B2

(12) United States Patent
Persson et al.

(10) Patent No.: US 9,238,515 B2
(45) Date of Patent: Jan. 19, 2016

(54) FILLING ASSEMBLY, GASKET FOR USE IN SAID FILLING ASSEMBLY, AND A METHOD FOR FILLING LIQUID

(75) Inventors: Jens Persson, Bunkeflostrand (SE); Göran Hermodsson, Staffanstorp (SE); Jonas Nilsson, Bunkeflostrand (SE); Simo Vallenback, Vellinge (SE)

(73) Assignee: TETRA LAVAL HOLDINGS & FINANCE S.A., Pully (CH)

( * ) Notice: Subject to any disclaimer, the term of this patent is extended or adjusted under 35 U.S.C. 154(b) by 700 days.

(21) Appl. No.: 13/515,998

(22) PCT Filed: Dec. 15, 2010

(86) PCT No.: PCT/SE2010/051383
§ 371 (c)(1),
(2), (4) Date: Jul. 10, 2012

(87) PCT Pub. No.: WO2011/075055
PCT Pub. Date: Jun. 23, 2011

(65) Prior Publication Data

US 2012/0266571 A1 Oct. 25, 2012

(30) Foreign Application Priority Data

Dec. 18, 2009 (SE) ..... 0901580

(51) Int. Cl.
*B65B 1/04* (2006.01)
*B65B 3/02* (2006.01)
(Continued)

(52) U.S. Cl.
CPC ..... *B65B 9/20* (2013.01); *B65B 31/045* (2013.01)

(58) Field of Classification Search
CPC ..... B65B 55/103; B65B 9/20; B65B 55/02; B65B 31/045; B65B 39/00
USPC ..... 53/473, 558, 129.1, 511, 510, 79, 403, 53/432–434, 450–452, 476, 86; 141/2
See application file for complete search history.

(56) References Cited

U.S. PATENT DOCUMENTS 2,113,636 A * 4/1938 Vogt ..... 53/433
2,160,367 A * 5/1939 Maxfield ..... 53/433
(Continued)

FOREIGN PATENT DOCUMENTS

CN 1307529 A 8/2001
CN 101208249 A 6/2008
(Continued)

OTHER PUBLICATIONS

English Language Translation of the Office Action (Notification of the First Office Action) issued on Aug. 2, 2013, by the Chinese Patent Office in corresponding Chinese Patent Application No. 201080057500.9. (5 pages).
(Continued)

*Primary Examiner* — Stephen F Gerrity
*Assistant Examiner* — Eyamindae Jallow
(74) *Attorney, Agent, or Firm* — Buchanan Ingersoll & Rooney PC

(57) ABSTRACT

A filling assembly for filling of a tube of packaging material having a seal starting at a first level, comprises a conduit arranged to lead liquid into the tube of packaging material below said first level and a passage arranged to eject gas through openings into the tube of packaging material below said first level. The filling assembly is characterized in that a gasket is arranged to provide a seal between said filling assembly and said tube of packaging material upstream said openings such that the overpressure $P_1$ downstream the gasket may exceed an ambient pressure $P_a$ upstream the gasket.

15 Claims, 3 Drawing Sheets

(51) Int. Cl.

| | |
|---|---|
| ***B65B 31/02*** | (2006.01) |
| ***B65B 5/02*** | (2006.01) |
| ***B65B 9/20*** | (2012.01) |
| ***B65B 31/04*** | (2006.01) |

(56) References Cited

U.S. PATENT DOCUMENTS

| | | | | |
|---|---|---|---|---|
| 3,163,971 | A * | 1/1965 | Loliger et al. | 53/426 |
| 3,165,035 | A * | 1/1965 | Stark | 493/302 |
| 3,466,841 | A * | 9/1969 | Rausing | 53/426 |
| 3,470,672 | A * | 10/1969 | Tuma | 53/493 |
| 3,716,083 | A * | 2/1973 | Tuma | 141/90 |
| 3,911,642 | A * | 10/1975 | Ernstsson et al. | 53/426 |
| 4,235,265 | A * | 11/1980 | Feliks | 141/85 |
| 4,606,174 | A | 8/1986 | Berg | |
| 4,617,779 | A | 10/1986 | Nygren et al. | |
| 4,641,486 | A | 2/1987 | Zannoni | |
| 4,750,534 | A * | 6/1988 | Hirasawa et al. | 141/114 |
| 4,784,697 | A | 11/1988 | Bordini | |
| 5,756,979 | A * | 5/1998 | Murakami et al. | 235/454 |
| 6,035,614 | A * | 3/2000 | Gustafsson et al. | 53/551 |
| 6,079,188 | A * | 6/2000 | Katayama et al. | 53/451 |
| 6,182,421 | B1 * | 2/2001 | Sullivan | 53/438 |
| 6,619,018 | B1 * | 9/2003 | Sasaki | 53/511 |
| 6,925,780 | B1 | 8/2005 | Anderson | |
| 2001/0005974 | A1 * | 7/2001 | Kondo et al. | 53/508 |
| 2004/0011688 | A1 * | 1/2004 | Ishikawa | 206/431 |
| 2004/0020941 | A1 * | 2/2004 | Engesser et al. | 222/135 |
| 2006/0162290 | A1 * | 7/2006 | Kakita et al. | 53/434 |
| 2008/0190967 | A1 | 8/2008 | Jacuk | |
| 2012/0145516 | A1 * | 6/2012 | Tokuda et al. | 198/533 |
| 2012/0210681 | A1 * | 8/2012 | Hennissen et al. | 53/559 |
| 2012/0228339 | A1 * | 9/2012 | Kaneko | 222/566 |

FOREIGN PATENT DOCUMENTS

| | | | |
|---|---|---|---|
| EP | 0 882 651 | A1 | 12/1998 |
| WO | WO 2006/073339 | A1 | 7/2006 |

OTHER PUBLICATIONS

Written Opinion of the International Searching Authority (Form PCT/ISA/237) issued on Nov. 3, 2011, in the corresponding International Application No. PCT/SE2010/051383. (4 pages).

Official Action issued on Jun. 10, 2010 by Swedish Patent Office in corresponding Swedish Application No. 0901580-1 (5 pages).

International Search Report (PCT/ISA/210) issued on Mar. 11, 2011, by the Swedish Patent Office as the International Searching Authority for International Application No. PCT/SE2010/051383.

* cited by examiner

FILLING ASSEMBLY, GASKET FOR USE IN SAID FILLING ASSEMBLY, AND A METHOD FOR FILLING LIQUID

TECHNICAL FIELD

The present invention relates to a package forming device, and in particular to a package forming device forming packages from a tube of packaging material.

BACKGROUND

When forming packaging containers made of packaging material such as laminate, there are at least two general techniques to follow. According to one technique each package is formed from an individual blank severed from a web of packaging material, which is formed into an individual packaging container, which in turn is filled with product. According to a second technique the web of material is longitudinally sealed to form a tube, and during sealing the tube is filled with product and then transversally sealed and severed to form individual containers. The present invention relates to the second technique. The skilled person realizes that the above description merely represents a rough classification and not an exhaustive list. To elucidate the relevant area further there are numerous different types of prior art apparatuses and arrangements for sealing packages once they have been filled with food and/or beverage products in filling machines. The packages are often manufactured from a tube of packaging material which is conveyed through a filling machine. The packaging material may consist of one or more layers of material depending upon the type of product which is to be filled in the packages. Certain packages are manufactured, for example, from a layer of plastic which is sealable by means of melting heat, occasionally a plurality of plastic layers, while other packages consist, for example, of a plurality of different material layers, such as a fibrous material, e.g. paper, which is coated on both sides with layers of meltable or fusible plastic, for example polyethylene, and may also include an additional material layer, for example of aluminium, which functions, as a barrier in aseptic packages.

The tube is conveyed in a per se known manner through the filling machine at the same time as it is filled the product, sealed and given its final configuration. The individual packages are sealed in that two sealing jaws which are displaced towards one another grip and compress the tube in transverse zones uniformly distributed along the length of the tube. The jaws consist of a counter jaw and a jaw for generating heat, for example a so-called ultrasound horn which generates the heat by means of ultrasound. The heat may also be generated in other ways, for example by means of constant heat or induction, for sealing of each respective compressed tube section by melting associated plastic material and thereafter severing each respective tube section so that individual packaging containers are obtained. Thereafter each packaging container is folded into the desired shape, which often is assisted by prearranged creasing lines in the packaging material. One example of the above is disclosed in WO2006073339.

In some instances the sealed and folded packaging container exhibits unacceptable production errors resulting from an imperfect sealing and folding process. These errors, such as dents, may be an aesthetic problem only, yet it may also result in defective seals, which in turn results in a discarded packaging container (and product contained therein). Further, dents may result in an increased risk of leakage during transportation of packaging containers, which may jeopardize the quality of packaging containers stored in the vicinity leaking one. Errors during the folding process may also result in poor standing stability for the finalized packaging container.

SUMMARY

The present invention aims at providing a novel filling assembly for a package forming machine eliminating or alleviating the above mentioned problem. This aim is achieved by a filling assembly according to claim 1. Specific embodiments are defined in the dependent claims. To this end the present invention provides:

A filling assembly for filling of a tube of packaging material, having a seal starting at a first level. The filling assembly comprises a conduit arranged to lead liquid into the tube of packaging material below said first level and a passage arranged to eject gas through openings into the tube below said first level, and is characterized in that a gasket is arranged to provide a seal between said filling assembly and said tube of packaging material below said openings such that the pressure $P_1$ below the gasket may exceed an ambient pressure $P_a$. Some of the beneficial features emanating from the establishment of an overpressure are disclosed in the detailed description.

In one or more embodiments the gasket is arranged to float in its suspension, such that there is a clearance between the gasket and a radially inner structure and that the maximum thickness of the gasket is smaller than its structural constraints. In this way the gasket may move in a horizontal plane with reduced frictional resistance. Should the relative position between the tube of packaging material and the filling assembly vary, this variation may be absorbed by the movability of the floating gasket, such that an adequate seal may be maintained.

In the one or several embodiments the gasket may comprise an annular body and a flange extending radially outwards from the annular body. The annular body may provide some structural stability/rigidity to the gasket, while the flange or skirt provides an adequate sealing contact surface to the inner perimeter of the tube of packaging material. The gasket may further, in one or more embodiments have a circumferential bead on a top surface of the annular body, such as to provide a suitable contact surface with an above structure, while minimizing crevices that are difficult to clean or sterilize.

In one or more embodiments the conduit arranged to lead liquid may be arranged concentrically within the passage arranged to eject gas, which is a simple way of obtaining a homogenous flow and an assembly which is easy to clean.

The actual overpressure may in one or more embodiments reside in an interval of about 0.11-0.18 bar, which of course depends on many factors to be described later on in the application.

The gasket may further be provided with openings extending essentially orthogonal to a plane defined by the circumference of the gasket. This fluid connection between the higher pressure side and the lower pressure side ensures the establishment of a continuous flow of air, which in turn simplifies the controllability of the pressure, since steep pressure gradients are less likely to occur.

As such the present invention also relates to a method for filling liquid into a tube of packaging material comprising the steps of: arranging an elevated pressure inside a volume of the tube of packaging material compared to the pressure outside of the tube of packaging material, and filling liquid into the tube of packaging material, in the volume having elevated pressure. The present invention also relates to the gasket per se.

DETAILED DESCRIPTION OF EMBODIMENTS

Figure 1:
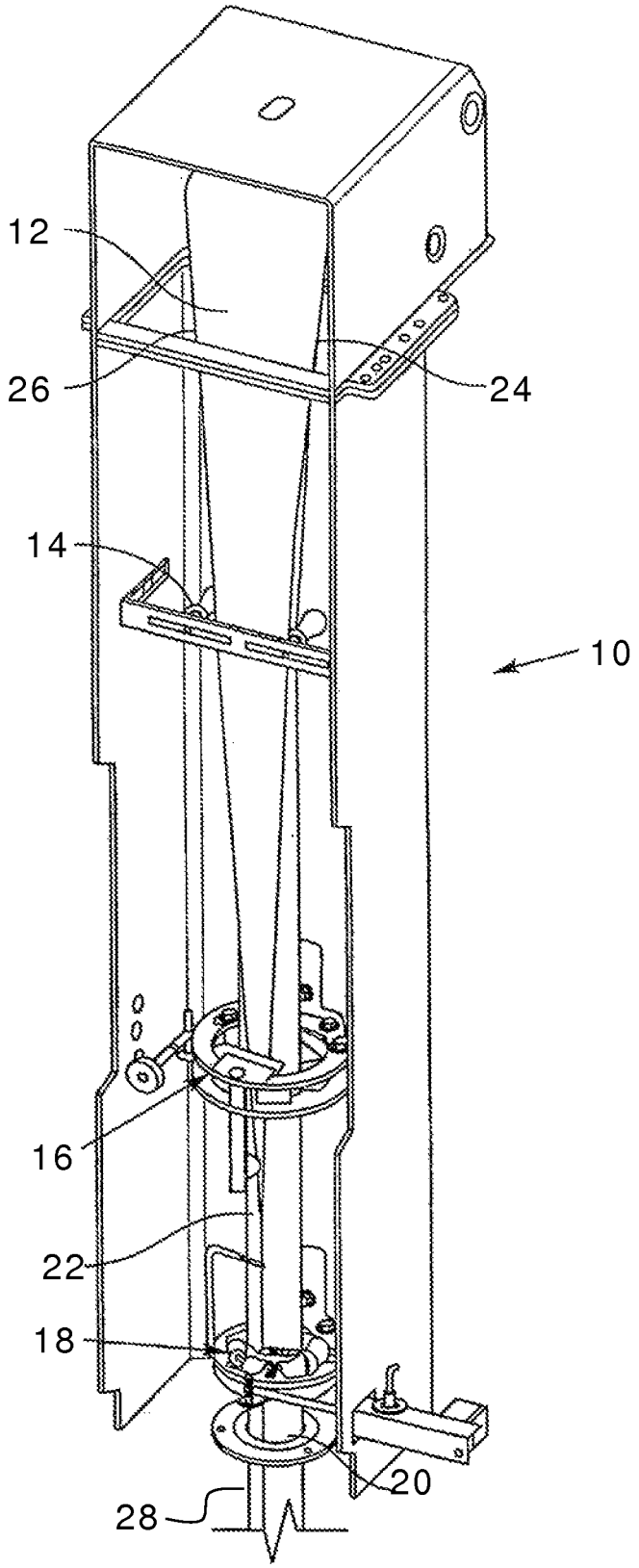
FIG. 1 is an overview of a filling machine in which the inventive filling assembly may be arranged.

FIG. 1 illustrates a part 10 of a machine for manufacturing packages from a web 12 of packaging material. The packaging material is of the initially described type, i.e. a paper core layer coated with a thermoplastic material. When passing through this particular part of the machine, a sealed tube is formed from the initially essentially plain web 12. The forming of the tube is effected by means of a number of tube-forming means 14, 16 and a device 18 comprised in the machine 10. The main task of the tube forming means 14, 16 is to initiate shaping (step A) of the web 12 into a tube 20 with an overlapping joint 22 between two mutually opposing edge sections 24 and 26 of the web, and these means are not described in detail herein. The device 18 is arranged to control a twist of the tube in relation to a sealing apparatus 28 for transverse sealing of the tube. The device 18 is further arranged to finish the shaping of the web by giving the tube 28 a desired diameter before longitudinally sealing the overlapping joint 22.

Further downstream the tube 28, now filled with product, is sealed with horizontal sealing jaws, clamping and sealing the tube 28. First a lower jaw clamps and seals a lower end of the packaging container (to be) and then an upper jaw clamps and seals an upper end of the container. The production process, and inevitably also the sealing process, is performed at a high rate; in the order of 10 000 packaging containers may be produced per hour. A problem that may occur is that the as the lower jaw clamps the lower end of the packaging container it causes the product to splash upwards in the tube 28, which in turn may cause a faulty amount of product in the package if the upper jaws clamps the tube 28 with an inappropriate timing. This problem and a suggested solution is disclosed in EP 0 882 651.

Figure 2:
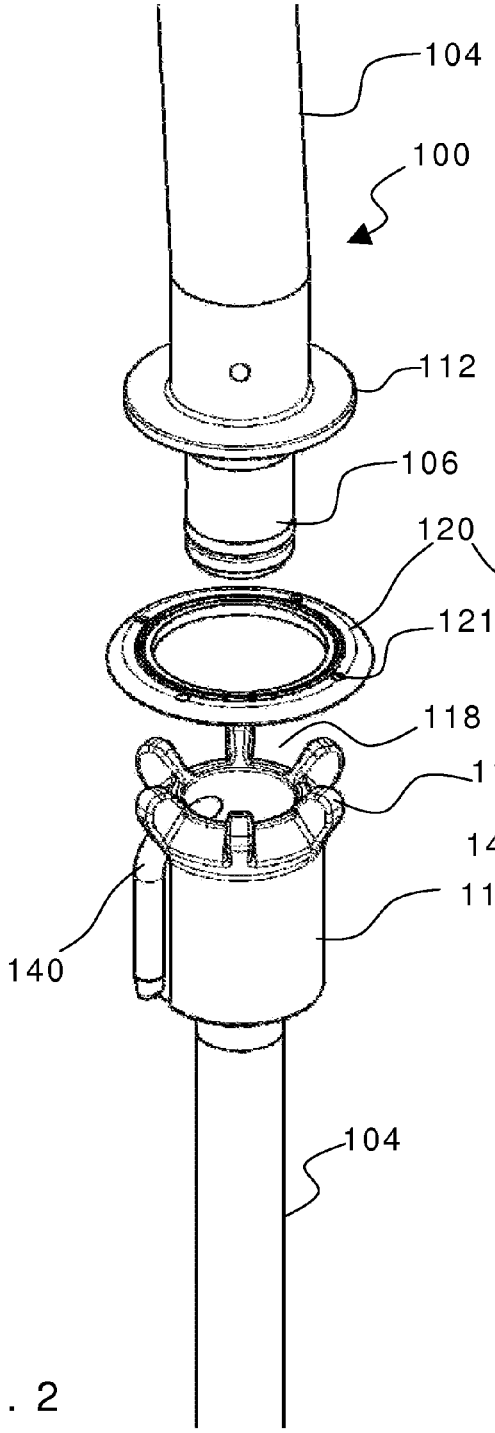
FIG. 2 is an exploded view of a filling assembly according to one embodiment of the present invention.
Figure 3:
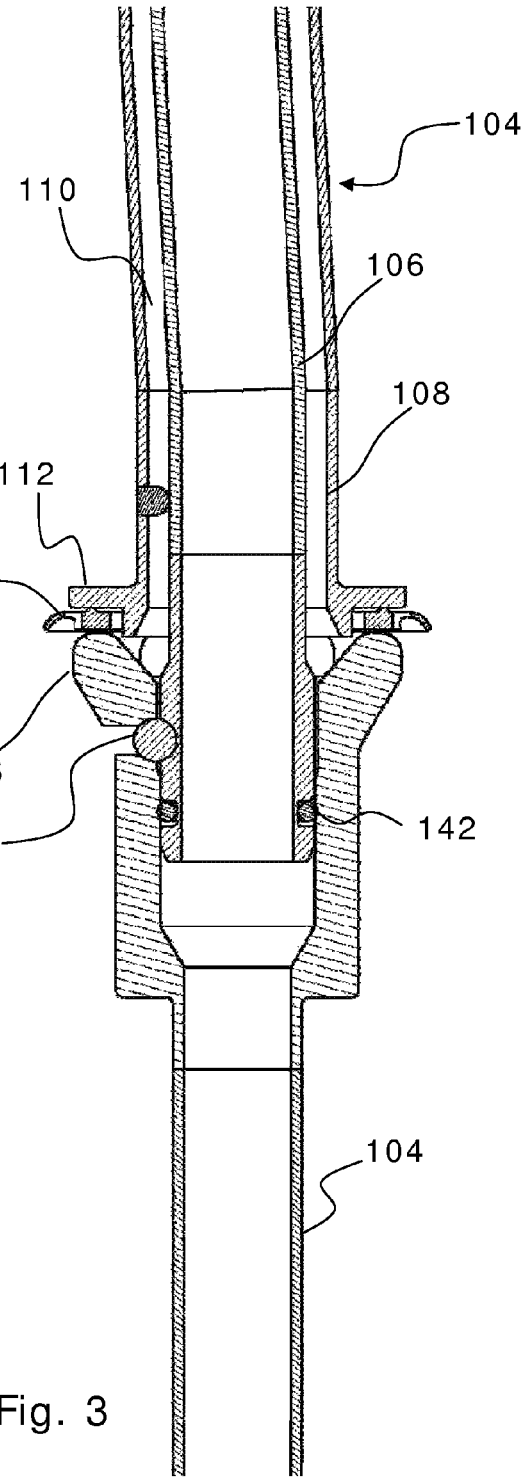
FIG. 3 is a cross section of the filling assembly of FIG. 2.

For simplicity the filling unit is excluded from the view of FIG. 1, yet FIG. 2 illustrates an exploded perspective view of a filling assembly 100 according to a first embodiment of the present invention, which constitutes a part of such filling unit. FIG. 3 in turn illustrates a cross section of the view of FIG. 2. The filling assembly is inserted into the tube 28, or rather the tube 28 is formed around the filling assembly 100. The filling assembly 100 thus fill the tube 28 continuously during production of packaging containers. The level of liquid inside the tube 28 may be controlled by means of a float-sensor arrangement which sends input to a control unit (not shown). The control unit controls a fill valve controlling the rate of liquid input, in a known manner. The filling assembly 100 according to the present embodiment comprises an upper filling pipe 102 and a lower filling pipe 104. Upstream the upper filling pipe 102 a supply unit for fluid and compressed air is arranged, yet for the purpose of the present invention an exact description of the complete filling unit is not critical. The upper filling pipe 102 has a central conduit 106 for leading liquid, which is concentrically arranged within a case pipe 108. In the annular passage or slit 110 between the conduit 106 and the pipe 108 compressed sterile air may be transported. The lower end of the case pipe 108 comprises an abutment flange 112, whereas the central conduit 106 extends beyond the abutment flange and extends sealingly into the lower filling pipe 104. A lock lever 140 engaging a slot holds the two pipes together, and an O-ring 142 ensures the seal. Consequently only liquid is led through the lower filling pipe 104. At its upper end the lower filling pipe 104 comprises a crown structure 114 having abutment projections 116 directed towards the abutment flange 112 of the case pipe 108. Between the abutment projections 116 openings or channels 118 are defined, such that compressed air may pass freely out through the crown structure 114 and into the tube 28 of packaging material. The distance between the outlet for pressurized air and the outlet for liquid product should be long enough to prevent foam, resulting from the filling procedure, from contacting the air outlets and the gasket 120. Since the tendency to foam will vary between different products it is not relevant to discuss distances in absolute terms. The distance may also be dependent on the space needed for the float in the float sensor arrangement. It may be said that the crown structure may be replaced by openings in the lateral sides of the lower filling pipe, arranged adjacent to the junction between the lower filling pipe and the filling pipe above. In the present embodiment, however, the abutment projections will reduce the contact area to the gasket, as compared to a continuous abutment rim, which facilitates cleaning and sterilisation.

Figure 4:
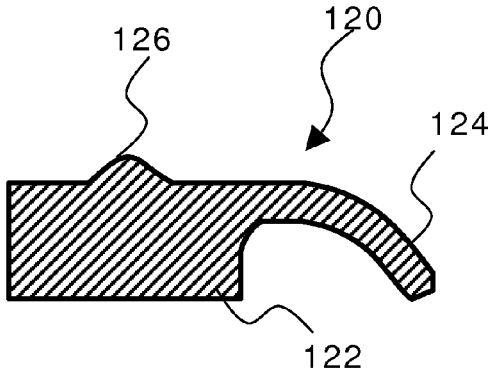
FIG. 4 is a schematic cross section of a sealing gasket used in the embodiments of FIGS. 2 and 3.

A sealing gasket 120 is arranged between the abutment flange 112 and the abutment projections 116. FIG. 4 is a schematic cross sectional view of the sealing gasket 120. The sealing gasket 120 is manufactured in one piece and comprises an annular body 122 from which a sealing skirt 124 extends. The sealing skirt 124 has a curved cross section and is dimensioned to abut against the interior walls of the tube 28 of packaging material, such as to enable the maintenance of a higher pressure inside the tube 28. In annular clearance is present inside of an inner radius of the annular body 122, and since the sealing gasket 120 is not attached to neither the upper 102 nor the lower sealing pipe 104 this enables for the sealing gasket 120 to float. This feature may be important as the position of the tube 28 of packaging material relative to the filling assembly may vary continuously. In a practical case a possibility to float 2-3 mm may suffice. The annular body 122 may further have an abutment portion 126 or bead with an essentially conical or frustoconical cross section extending towards the abutment flange 112, thus ensuring an adequate seal. The gasket may be manufactured from any material having the right properties such as being resistant to the sterilization agent used to sterilize the packaging material, e.g. hydrogen peroxide, and heat. A low friction is also a beneficial property, since this will increase the life span of the gasket and reduce the risk of gasket residues ending up inside a packaging container. The ambient temperature in the vicinity of the gasket may be in the order of about 80-90° C.

In the illustrated embodiment it is not clearly visible, yet it should be noted that the shortest distance between the abutment flange and an opposing abutment projection exceeds the width (height in the view of FIG. 3) of the sealing gasket 120, which enables the gasket to float freely.

On an upper surface of the annular body 122 a circumferential bead 126 may be arranged. The bead facilitates the seal between the gasket and the abutment flange, and also reduces the contact surface there between. The reduced contact surface is beneficial during cleaning and sterilization of the filling unit, since adequate access to all surfaces then may be obtained. The gasket 120 may also have through holes or openings 121 distributed around its circumference. These openings 121 extend in a generally vertical direction when the gasket 120 is in a use position, which also may be expressed as they extend orthogonal to a plane defined by the circumference of the gasket 120. Through these openings 121 a continuous flow of air may be arranged as there is a pressure difference over the gasket 120. This continuous flow facilitates the control of the increased pressure in the tube, since it makes the pressure more predictable, and reduces the risk of steep gradients in pressure over time.

Consequently, as the tube 28 forming is started the gasket will be pulled downwards by the inner walls of the tube 28, yet as the pressure is increased it will push the gasket upwards, towards the abutment flange. An overpressure of 0.11-0.18 bar has proven functional for the present embodiment. The lower limit is set by the quality of the resulting packaging containers, and the upper limit is set by the strength of the longitudinal seal. This overpressure will assist in the forming of packaging containers and also reduce the amount of splashing inside the tube 28. The skilled person realises that the pressure will vary during the production of packaging containers. Every time a sealing jaw clamps the tube 28 of packaging material the pressure will increase, yet on a whole the behaviour of the system is quite stable. The control may therefore be accomplished by the arrangement of a pressure sensor. The output of the pressure sensor may be sent to a control unit which evaluates a mean pressure over several cycles, and the control unit may in turn control a mass flow valve such that a mean pressure exceeding e.g. 0.14 bar leads to a reduction in mass flow and a mean pressure less than 0.14 bar leads to an increase in mass flow. There are of course more than one way for the skilled person to resolve control issues once being aware of the problem. The pressure sensor may be located just downstream of the control valve (the mass flow valve).

Figure 5:
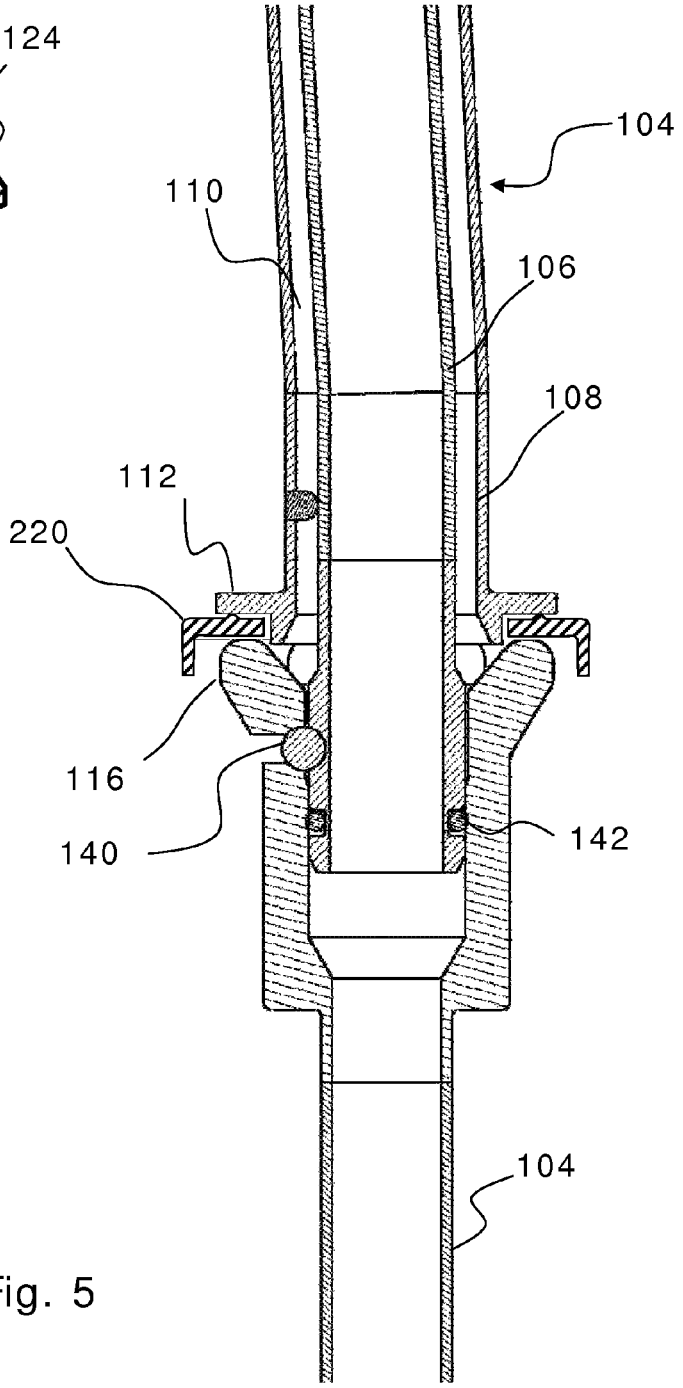
FIG. 5 is a cross section similar to FIG. 3, yet illustrating a gasket of a second embodiment

In the embodiment illustrated in FIG. 5 a gasket 220 according to another embodiment is illustrated. This gasket 220 resembles the gasket 120 in many ways, yet it differs in a few.

1) The gasket is manufactured from a rigid material, such as a metal, preferably stainless steel.
2) There are no openings 121 for passage of air, instead
3) The outer diameter of the gasket is slightly smaller than the inner diameter of the tube 28 of packaging material.
4) In the illustrated embodiment the flange or skirt of the gasket (formed in one piece with the rest), in particular the distal end thereof, extends parallel to the tube.

The behaviour of a gasket according to this embodiment will be similar to the behaviour for the gasket previously described, at least on a general level; it will float and easily be moved as the tube 28 moves (cross the travel direction). One specific difference is that excess air will, and is meant to, slip out in the gap between the tube 28 and the skirt. While the gasket of the first embodiment is designed to float and move in order to maintain a seal between the skirt and the tube, the present gasket is designed to float and move in order not to exert too much force on an inner wall of the tube. The shape of the skirt, and in particular the portion of the skirt expected to experience contact with the tube wall, is designed to increase the contact surface. In this way the risk of a sharp edge damaging the interior of the tube is reduced. Another reason for the design of the skirt is that it will generate a long, narrow gap between the tube and the skirt, which prevents rapid fluctuations of the air flow.

The gasket 220, and in particular the portion of the gasket 220 which may be in contact with the tube is preferably surface treated such as to reduce friction. This may also be true for the portion of the gasket being in contact with the abutment flange 112.

A gasket in accordance with the present embodiment provides excellent controllability and a durable component. The inherent gap between the skirt and the tube reduces the risk of micro-sized particles getting stuck, and it also provides a solution which is very gentle to the tube of packaging material.

In this context it may be mentioned that the ambient pressure upstream the gasket does not have to correspond to the atmospheric pressure, and generally it does not. While being upstream the gasket, this region is still inside the filling machine, and it is common to apply a slight overpressure inside the machine, such as to prevent impurities from entering the filling machine. The ambient pressure upstream the gasket may consequently correspond to a slight overpressure as compared to atmospheric pressure.

To improve the strength of the longitudinal seal, means may be arranged to cool the area of the longitudinal seal between the sealing position and the segment of elevated pressure. An example of such means is a simple orifice ejecting a cooling airflow towards the area of the seal.

The present invention enables the establishment of a continuous overpressure in the region downstream the gasket, resulting in the advantages already mentioned.

Another inventive concept may include the actual lower filling pipe. Such a filling pipe is adapted for arrangement below an upper filling pipe, preferably a double-walled upper filling pipe, wherein a central part of one end of the lower filling pipe is adapted to receive a portion of the upper filling pipe. Said end as a crown-like design, with projections extending in the general length direction of the lower filling pipe, away from the pipe. Adjacent projections define between them passages for fluid, generally compressed air, and a top surface of each projection is adapted to abut a gasket.

The invention claimed is:

1. A filling assembly for filling of a tube of packaging material having a longitudinal seal starting at a first level, said assembly comprising:

a conduit arranged to lead liquid into the tube of packaging material below said first level, a passage arranged to eject gas through openings into the tube below said first level, wherein a gasket is arranged to provide a seal between said filling assembly and said tube of packaging material upstream said openings such that an overpressure $P_1$ downstream the gasket may exceed an ambient pressure $P_a$ upstream the gasket, an outer diameter of the gasket is smaller than the inner diameter of the tube, the gasket comprises an annular body possessing a top surface and a flange extending radially outwards from the annular body, and a circumferential bead on the top surface of the annular body of the gasket, wherein the conduit arranged to lead liquid is arranged concentrically within the passage arranged to eject gas.

2. The filling assembly of claim 1, wherein the gasket is movable, such that there is a clearance between the gasket and a radially inner structure and that the maximum thickness of the gasket is smaller than its structural constraints.

3. The filling assembly of claim 1, wherein at least a portion of the flange extends parallel to the tube of packaging material.

4. The filling assembly of claim 1, wherein the gasket is formed in one piece.

5. The filling assembly of claim 1, wherein the overpressure $P_1$ resides in an interval of about 0.11-0.18 bar.

6. The filling assembly of claim 1, wherein the gasket is provided with openings extending essentially orthogonal to a plane defined by the circumference of the gasket, which openings preferably are arranged in a flange extending radially outwards from an annular body.

7. The filling assembly of claim 1, wherein the gasket rests on several individual abutment projections extending from a lower filling pipe, such that the openings are defined between said abutment projections.

8. A gasket for use in a filling assembly of claim 1, said gasket comprising an annular body from which a flange extends radially outwards, said annular body comprising a circumferential bead on a top surface thereof.

9. The gasket of claim 8, wherein an outer diameter of the gasket is smaller than an inner diameter of a tube in which it is to be arranged.

10. The gasket of claim 8, wherein the gasket is provided with openings extending essentially orthogonal to a plane defined by the circumference of the gasket.

11. The gasket of claim 8, wherein the gasket is formed in one piece.

12. A filling assembly for filling a tube of packaging material, which possesses an inner surface and includes a longitudinal seal starting at a first level, the filling assembly comprising:

a conduit arranged to lead liquid into the tube of packaging material below the first level;

a passage arranged to eject gas through openings and into the tube of packaging material below the first level;

a gasket configured to provide a seal between the filling assembly and the inner surface of the tube of packaging material at a position upstream of the openings so that an overpressure $P_1$ downstream of the gasket exceeds an ambient pressure $P_a$ upstream of the gasket;

the gasket including an annular body and a flange extending radially outwards from the annular body, the annular body and the flange being integrally formed in one-piece;

the annular body of the gasket possessing a bottom surface facing towards the openings and an oppositely located top surface; and a circumferential bead on the top surface of the annular body of the gasket;

wherein the conduit arranged to lead the liquid into the tube of packaging material possesses an inner surface positioned to face the liquid when the liquid is introduced into the conduit, and an outer surface positioned to face an inner surface of the passage arranged to eject the gas through openings into the tube of packaging material.

13. The filling assembly of claim 12, further comprising an upper filling pipe in which the conduit is located, the upper filling pipe including an outwardly extending flange, and the circumferential bead on the top surface of the annular body of the gasket contacting the outwardly extending flange of the upper filling pipe.

14. The filling assembly of claim 13, further comprising a lower filling pipe possessing an upper end, the upper end of the lower filling pipe including a plurality of circumferentially spaced apart projections, each of the openings being located between a circumferentially adjacent pair of the projections, the gasket being located between the outwardly extending flange of the upper filling pipe and upper ends of the projections of the lower filling pipe.

15. A filling assembly for filling a tube of packaging material, which possesses an inner surface and includes a longitudinal seal starting at a first level, the filling assembly comprising:

a conduit arranged to lead liquid into the tube of packaging material below the first level;

a passage arranged to eject gas through openings and into the tube of packaging material below the first level;

a gasket configured to provide a seal between the filling assembly and the inner surface of the tube of packaging material at a position upstream of the openings so that an overpressure $P_1$ downstream of the gasket exceeds an ambient pressure $P_a$ upstream of the gasket;

the gasket including an annular body and a flange extending radially outwards from the annular body, the annular body and the flange being integrally formed in one-piece;

the annular body of the gasket possessing a bottom surface facing towards the openings and an oppositely located top surface;

a circumferential bead on the top surface of the annular body of the gasket;

an upper filling pipe in which the conduit is located, the upper filling pipe including an outwardly extending flange, and the circumferential bead on the top surface of the annular body of the gasket contacting the outwardly extending flange of the upper filling pipe; and a lower filling pipe possessing an upper end, the upper end of the lower filling pipe including a plurality of circumferentially spaced apart projections, each of the openings being located between a circumferentially adjacent pair of the projections, the gasket being located between the outwardly extending flange of the upper filling pipe and upper ends of the projections of the lower filling pipe.

* * * * *